United States Patent [19]

Short et al.

[11] Patent Number: 5,069,287

[45] Date of Patent: Dec. 3, 1991

[54] RETRIEVABLE GUIDE BASE FOR SUBSEA WELL

[75] Inventors: David E. Short, Houston, Tex.; Arthur G. Ahlstone, Ventura, Calif.; William A. Valka, Spring, Tex.

[73] Assignee: FMC Corporation, Chicago, Ill.

[21] Appl. No.: 561,542

[22] Filed: Aug. 1, 1990

[51] Int. Cl.[5] ..... E21B 7/128

[52] U.S. Cl. ..... 166/339; 166/348; 166/349; 166/342; 166/351; 166/365; 175/10

[58] Field of Search ..... 166/338, 339, 340, 342, 166/349, 351, 360, 365; 285/23, 39, 80, 86, 141, 317, 415, 419; 175/10

[56] References Cited

U.S. PATENT DOCUMENTS

| | | | |
|---|---|---|---|
| 3,934,658 | 1/1976 | Nelson | 175/7 |
| 3,973,635 | 8/1976 | Gatlin et al. | 175/7 |
| 4,387,771 | 6/1983 | Jones | 166/349 |
| 4,540,053 | 9/1985 | Baugh et al. | 166/348 |
| 4,597,448 | 7/1986 | Baugh | 166/348 |
| 4,611,661 | 9/1986 | Hed et al. | 166/339 |
| 4,615,544 | 10/1986 | Baugh | 166/348 |
| 4,832,124 | 5/1989 | Davis | 166/339 |
| 4,836,579 | 6/1989 | Wester et al. | 285/23 |
| 4,880,061 | 11/1989 | Ahlstone | 166/348 |
| 4,881,850 | 11/1989 | Abreo, Jr. | 166/338 |
| 4,902,044 | 2/1990 | Williams et al. | 285/419 |
| 4,927,295 | 5/1990 | Knowles | 166/349 |
| 4,960,174 | 10/1990 | Rodrigues et al. | 166/365 |

*Primary Examiner*—Ramon S. Britts
*Assistant Examiner*—Roger J. Schoeppel
*Attorney, Agent, or Firm*—W. William Ritt, Jr.; Richard B. Megley

[57] ABSTRACT

A retrievable guide base and gimbal unit for a subsea well, and a tool for use with a pipe running to retrieve the guide base and gimbal from the subsea wellhead.

11 Claims, 8 Drawing Sheets

48
52
75
68
70
68
66
72
46
74
64
54
50
92
62
62
92
60
58
58a
58a
36
90
56
36
90
56
50a
20
24
50a
24
22
32
22
26
26
34
28
28
30

RETRIEVABLE GUIDE BASE FOR SUBSEA WELL

BACKGROUND OF THE INVENTION

This invention relates to subsea well drilling systems, and more particularly to permanent guide bases for such systems.

When drilling for oil and gas wells from a floating drilling rig, a permanent guide structure is attached to a 30 inch wellhead housing which is mounted on a 30 inch conductor pipe extending down into the wellbore. The guide structure usually has four upstanding posts on a six foot radius, 90 degrees apart. The posts are usually 8 ⅝ inches in diameter and might be five or more feet tall, the height depending on the other subsea equipment that will have to mate with the wellhead housing during the drilling and completion of the subsea well. Guide lines, which extend from the posts back to the floating drilling rig, are used to guide the subsea equipment packages to and from the subsea well site and the wellbore. The inside of the center section of the guide structure is designed to accept and trap the subsea 30 inch wellhead housing which has a standard internal preparation to accept a variety of smaller wellhead housing sizes such as those with 21 ¾ inch, 18 ¾ inch, or 16 ¾ inch bores. The inside of the center section of the guide structure also has a landing shoulder to support the housing and a lock means, such as a bolted flange, for trapping the wellhead housing in the center section of the guide structure. Usually the 30 inch wellhead housing has an external slot down its side, and the bore of the center section of the guide structure has an orientation pin in order to align outlets in the housing with outlets built into the guide structure.

The 30 inch wellhead housing is landed in and attached to the guide structure, and the housing (with attached guide structure) is then run to the ocean floor and landed on an "upward" facing funnel of a temporary guide base which is resting on the ocean floor. Either bolted or welded to the bottom of the guide structure is a spherical rib section which permits the guide structure to gimbal with respect to the funnel on the temporary guide base. Sometimes the ocean floor is not level, and the gimbal capability permits the guide structure and wellhead housing with conductor pipe to align itself with the vertical/nearly vertical well bore, so that it can be cemented into position. Some designs did not provide for removal or recovery or replacement of the guide structure or its spherical rib gimbal section and still leave the wellhead housings in place. With those designs, if the guide structure had to be recovered, recovery of the wellhead housings as well was required. If a guide structure was damaged, there was no way to repair or change it. If mechanical damage occurs to a post on a guide structure, many guide structure designs permit replacement of a post, some by divers but others without the aid of divers. Since four posts are provided on guide structures, one might be omitted and guidance of equipment onto or off of the wellhead housing can still be accomplished. In some cases, the damaged post might be the key post for Xmas Tree installation or flow line pull-in and attachment, and if two or more posts or a key post are damaged, then the well might have to be abandoned.

Subsea wells are very expensive, usually tens of millions of dollars each, so that abandonment can be an expensive loss. Sometimes an exploratory well may be drilled through a more basic guide structure, but if good production is found it may be desireable to convert to a production well. The removal of the basic guide structure and its replacement with a production guide structure having flowline pull-in and attachment capability might save a lot of money and permit quicker cash flow from a discovery well. Furthermore, in some cases the operator wants to recover and reuse the wellhead equipment as well as the guide structure, gimbal, and temporary base, all of which requires a means to disconnect this equipment from the wellhead housing.

SUMMARY OF THE INVENTION

The foregoing problems are overcome, and the needs of the industry satisfied, by the present invention that comprises an easily releasable and retrievable subsea well permanent guide base together with a gimbal assembly that is fixed to, and thus unitary with, the base. The invention also facilitates installation of a replacement guide base or structure on a 30-inch or other size wellhead housing using the same attachment point as that used by the original guide base.

In accordance with the present invention, a permanent guide base or structure is releasably connected to a subsea well housing by an expandable split locking ring that resides in two annular grooves, one on the outside of the well housing and the other on the outside or inside of the central annular structural member of the guide base surrounding said well housing. When the locking ring is in proper position it locks the guide base to the wellhead housing and prevents any relative axial movement between them. This can be accomplished without the need for any human intervention, thereby avoiding a potential hazard. The locking ring thus functions as a support for the wellhead housing without need for any additional landing shoulder or other supporting member, as well as a restriction against upward movement of the guide base with respect to the housing. This latter function thereby enables the guide base to provide the necessary foundation for the guidelines that extend from the base to the surface drilling rig.

The locking ring is inherently biased into its contracted condition wherein it locks the guide base to the wellhead housing so that additional means to maintain the ring in locking position are not required. When release of the guide base from the wellhead housing is desired, the locking ring is expanded out of the groove in the housing by a retrieval tool run on a drill or other pipe string, and the guide base can then be retrieved simply by lifting it to the surface. In the following described preferred embodiment, expansion of the locking ring is achieved by a camming force exerted by a release ring surrounding the central annular structure of the guide base beneath the locking ring, when the release ring moves upward with the retrieval tool during the retrieval procedure. In other embodiments the locking ring is expanded by insertion of a tool between the ring's opposed ends where it is split, and energizing the tool to spread those ends. These other locking ring embodiments also include radially oriented receptacles on both sides of the split to accept a spreading tool carried by a remote operating vehicle.

The retrieval tool includes a hydraulic piston positioned to descend onto the top of a second wellhead housing within and terminating above the outer housing to which the guide base is attached, and to apply a sufficient lifting force on the tool to disengage the guide base from the outer housing. The piston is energized by dropping a ball down the retrieval tool running string onto a seat in the top of the hollow piston stem, and pressuring up the fluid, normally sea water, in the string.

Since no divers are necessary to run and land the permanent guide base of this invention, and likewise none are necessary to release and retrieve it from the subsea well housing, this invention can be utilized at any water depth where subsea wells can be drilled. Furthermore, it should be understood that the connection between the retrieval tool and the guide base can be accomplished either at the surface rig or at the subsea wellhead on the sea floor.

DESCRIPTION OF THE PREFERRED EMBODIMENT

Figure 1:
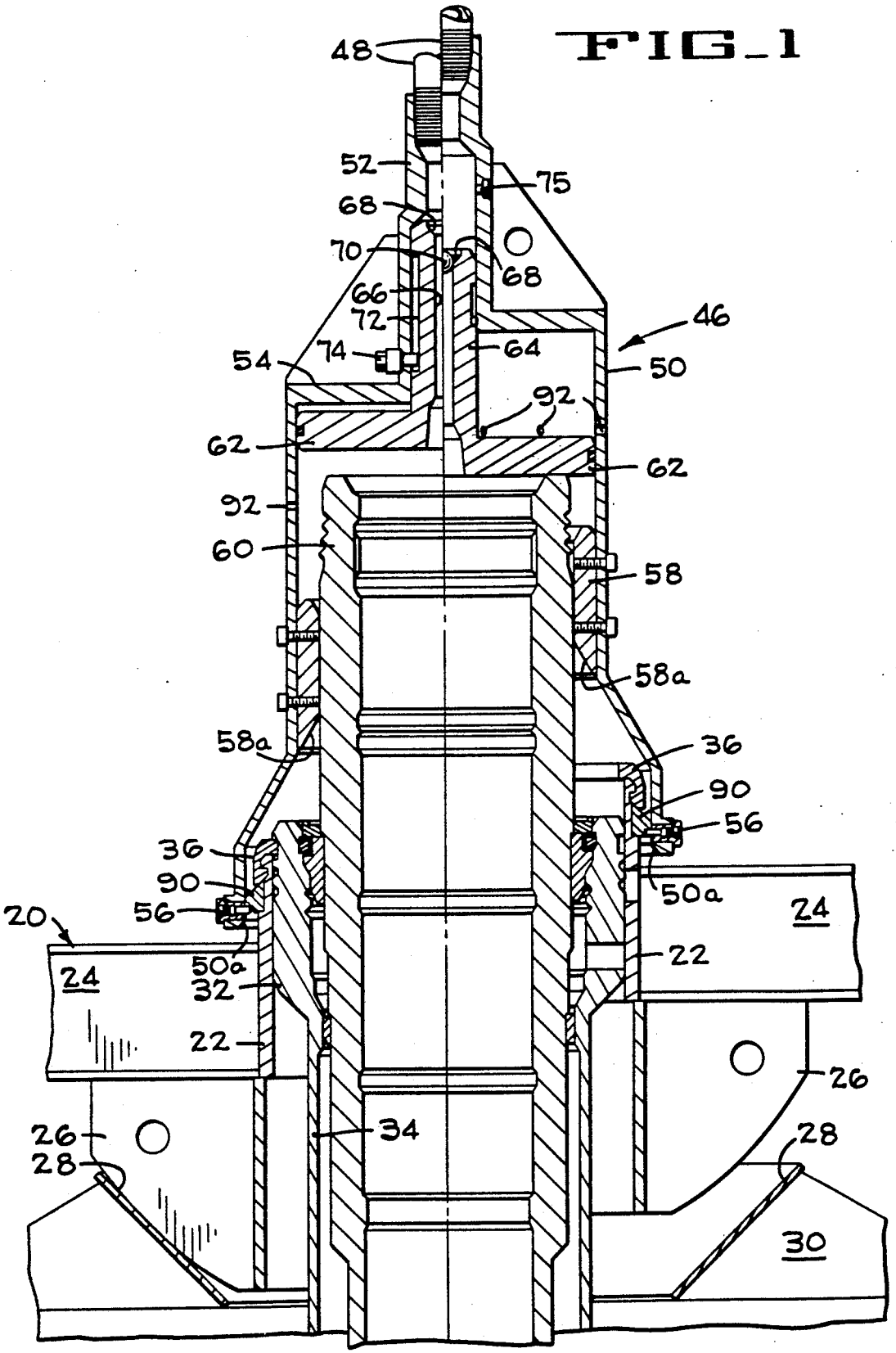
FIG. 1 is a central vertical section through two concentric subsea wellhead housings, a fragmentary central portion of a temporary guide base and a retrievable permanent guide base, and a permanent guide base retrieval tool according to the present invention, showing in the left half the permanent guide base connected to the outer housing and the tool latched to the guide base, and in the right half the guide base released from the housing and lifted off the temporary guide base.

As seen best in FIG. 1, the preferred embodiment of a retrievable permanent guide base structure 20 according to the present invention comprises a central vertical tubular element 22, a plurality of horizontal struts 24 (only portions of two shown) radiating laterally from the central element 22 for supporting guide posts and other guide base elements (not shown) in the usual manner, and a gimbal section 26 that rests in an upward facing funnel 28 on a temporary guide base 30. During drilling operations the temporary guide base is installed on the sea floor, the hole for the conductor pipe is drilled through the funnel 28, and the permanent guide base 20, the conductor pipe housing 32 and its string of conductor pipe 34 lowered as a unit from the drilling rig. The conductor pipe string is run into the well bore until the permanent guide base gimbal 26 lands on the temporary guide base funnel 28, whereby the funnel and temporary guide base support the conductor string and permanent guide base while the string is being cemented in place. The resulting cement foundation provides support for the conductor string and the other strings of casing and tubing which are eventually run into the final wellbore, and also for the blowout preventer stacks and the upward and sideward loads which are generated by a tensioned marine riser system.

The permanent guide base 20 and the conductor pipe housing 32 are releasably connected together by an expandable split locking ring 36 (FIGS. 1 and 3) with upper and lower inward extending radial flanges 38, 40, the upper flange 38 residing in an annular groove 42 in the outer surface of the conductor housing 32, and the lower flange 40 residing in a annular groove 44 in the outer surface of the permanent guide base central element 22. When the ring 36 is in its functional position as shown in FIG. 3 and the left half of FIG. 1, it prevents relative axial movement between the permanent guide base 20 and the housing 32, thereby serving to support the conductor housing in the permanent guide base while they are lowered and the until the conductor pipe is cemented, and also to prevent upward movement of the permanent guide base, and structures attached to it, with respect to the conductor housing.

Figure 2:
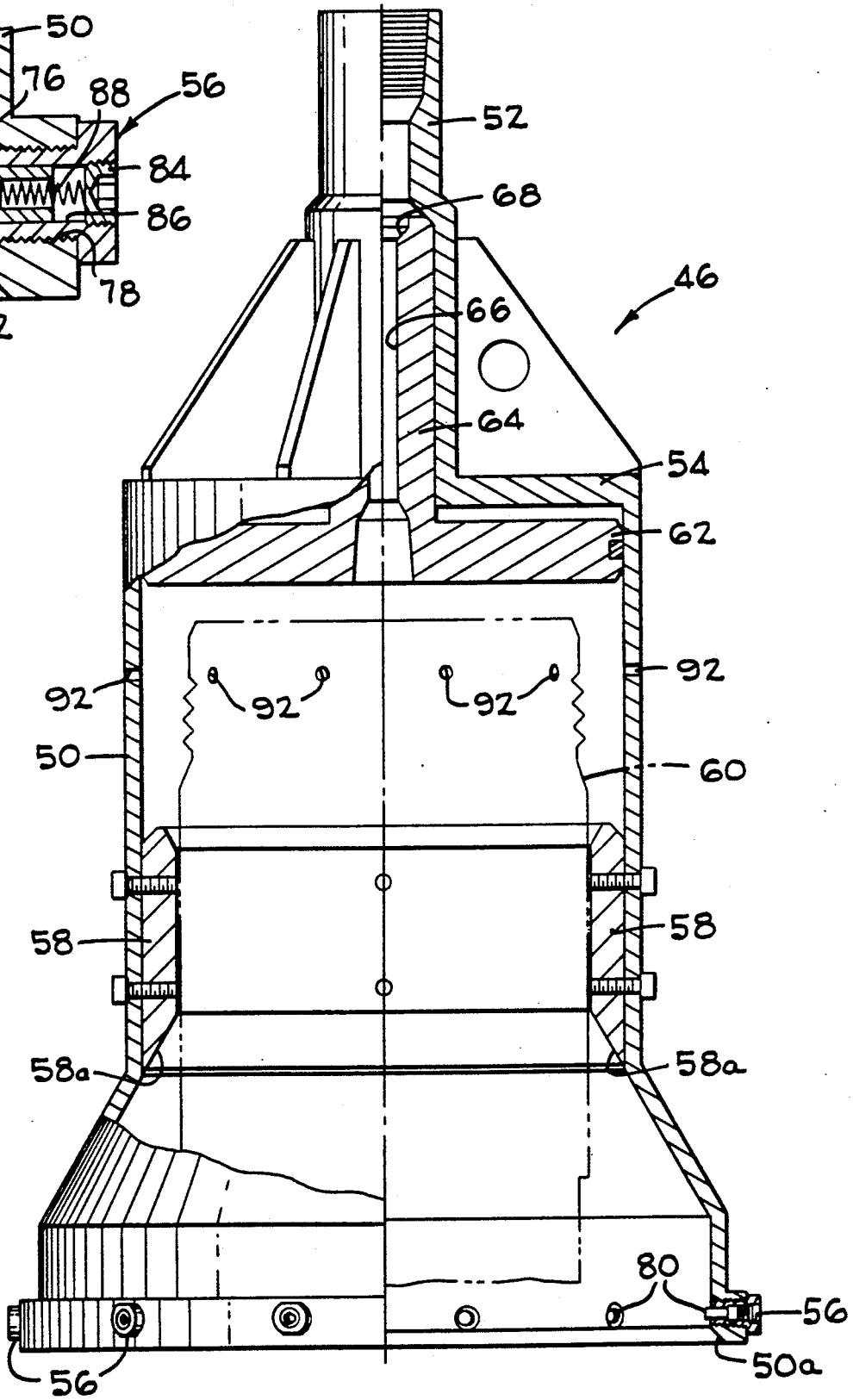
FIG. 2 is a front elevation of the retrieval tool of FIG. 1, on an enlarged scale and with some parts in vertical central section.
Figure 5:
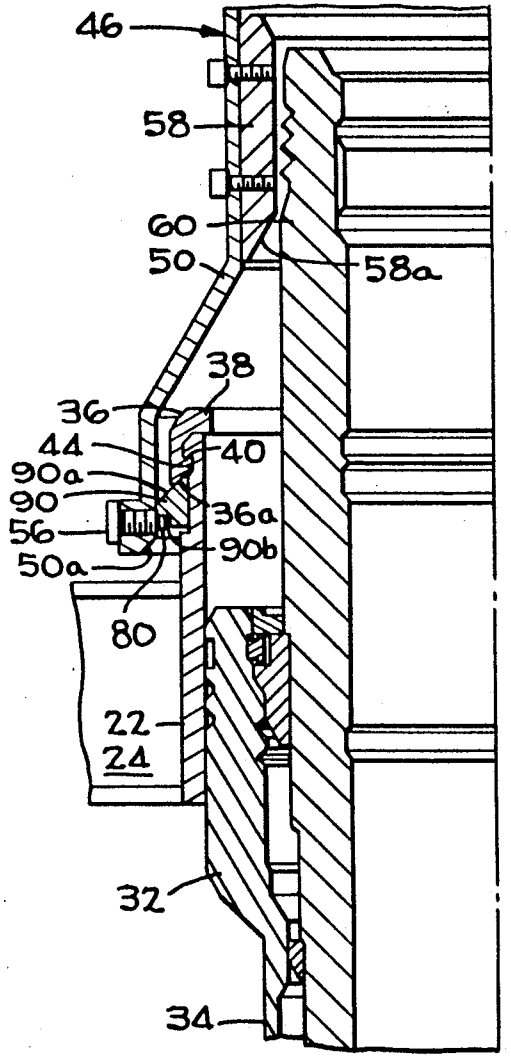
FIG. 5 is a view like FIGS. 3 and 4, but showing the guide base and retrieval tool lifted further with respect to the wellhead housing, and the locking ring in its contracted position on the guide base.
Figure 3:
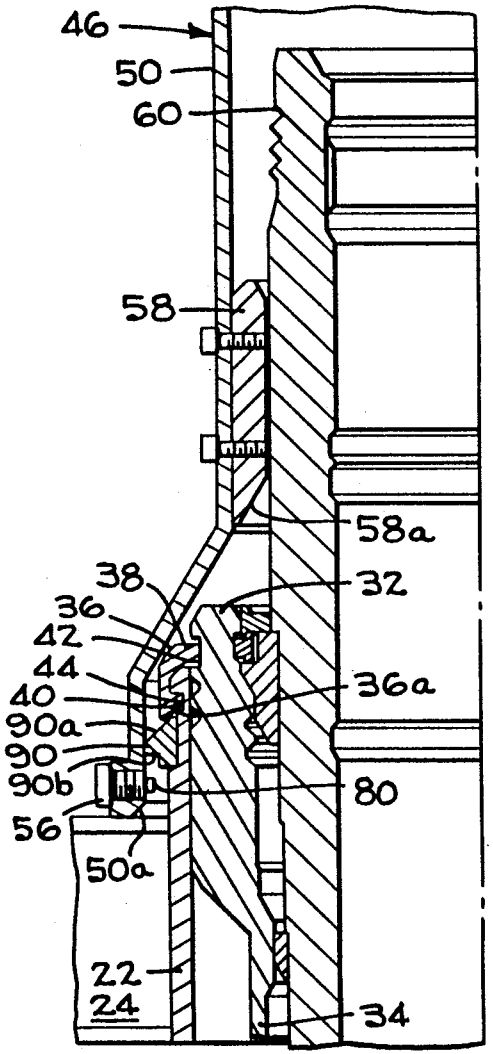
FIG. 3 is a fragmentary view, on an enlarged scale, of the wellhead housings, permanent guide base and retrieval tool of FIG. 2, showing the relative positions of the components just prior to commencement of the guide base releasing operation.

When retrieval of the permanent guide base 20 is desired, a retrieval tool 46 (FIGS. 1 and 2) is lowered from the drilling rig or other surface facility (not shown) on a pipe string 48 until it comes to rest on the base 20 as shown in FIG. 3. The retrieval tool 46 comprises a somewhat bell-shaped housing 50 with a central tubular extension 52 upstanding from its upper end wall 54, a plurality of circumferentially spaced retrieval pin assemblies 56 at its lower end portion, an adapter bushing 58 for use with an inner casing head or housing such as shown at 60, and a hydraulic piston 62 with a stem 64 that resides in the bore of the extension 52. The piston stem 64 has a central bore 66 with an annular seat 68 at its upper end to receive a ball 70 for closing the bore 66 when disengagement of the running tool 46 from the permanent guide base 20 is desired. A longitudinal groove 72 in the outer surface of the piston stem 64 cooperates with a piston retainer, such as a bolt 74, to retain the piston in place but permit its vertical movement with respect to the housing, and a shear pin 75 between the housing extension 52 and the piston stem 64 secures the piston in its upper position, as seen in the left half of FIG. 1, until it is sheared during the disengagement procedure.

Figure 6:
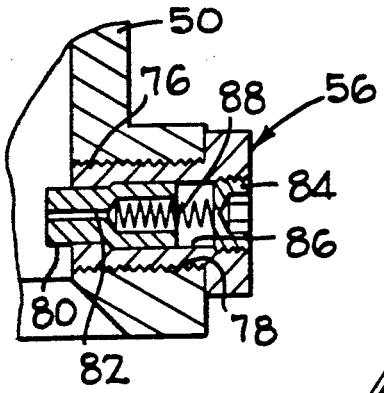
FIG. 6 is an enlarged fragmentary sectional view of one of the retrieval pin assemblies circumferentially spaced around the lower end of the retrieval tool of FIGS. 1-5.

As seen best in FIG. 6, each retrieval pin assembly 56 comprises an outer T-shaped sleeve 76 threaded to a radial port 78 in the housing 50, a tubular latch element 80 with a central pressure relief bore 82, an end closure element 84 threaded into the outer end of the bore 86 in the sleeve 76, and a helical spring 88 extending between the closure element 84 and the latch element 80 that biases the latch element inward towards its ring-engaging position as shown in FIGS. 1–6.

Employing the retrieval tool 46 to release and retrieve the permanent guide base 20 from the conductor pipe housing 32 involves the following steps. With the tool connected to a pipe running string 48 and the piston 62 held in its upper position (left half of FIG. 1) by the shear pin 75, the tool is lowered toward the subsea well. Frusto-conical surfaces 50*a* on the lower edge of the tool housing 50 and 58*a* on the lower end of the adapter bushing 58 assist in guiding the tool 46 onto the conductor housing 32 and inner casing head 60, respectively. As the retrieval pin assemblies 56 approach the locking ring 36 any of the assembly latch elements 80 that contact the ring 36 are cammed outwardly against pressure of their springs 88 to permit further downward movement of the tool. In similar manner, as the latch elements 80 contact the frusto-conical surface 90*a* on the upper end of a ring 90 surrounding the conductor housing 32 beneath the locking ring 36 they are cammed outwardly to facilitate their downward movement past the ring 90 and further descent of the tool 46 to its final rest position on the guide base 20 (FIG. 3).

Figure 4:
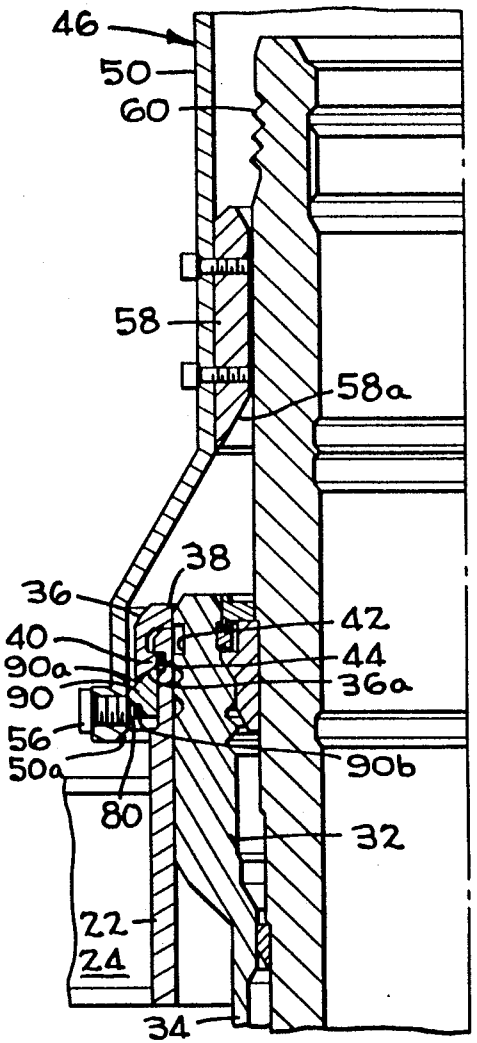
FIG. 4 is a view like FIG. 3, showing the locking ring and guide base released from the outer wellhead housing and partially lifted therefrom.

The retrieval tool 46 is then moved upward from its FIG. 3 position, either (1) by lifting the running string 48, (2) by dropping the ball 70 down the running string and onto its seat 68, and then hydraulically pressuring the piston 62 downward onto and against the upper end of the inner casing head 60 (right half of FIG. 1), or (3) by employing both methods (1) and (2) simultaneously. As the latch elements 80 of the retrieval pin assemblies 56 move upward they contact the lower radial surface 90*b* of the ring 90 and carry the ring upward also. As the ring 90 moves upward its frusto-conical surface 90*a* applies a camming force against the lower frusto-conical surface 36*a* of the locking ring 36, causing the locking ring to expand until its upper flange 38 has exited the groove 42 in the conductor housing 32. At this point the permanent guide base 20 is disengaged from the conductor housing 32 and begins its upward movement with the retrieval tool 46 (FIG. 4). As the locking ring upper flange 38 moves above the conductor housing 32 it contracts into its original locked position (FIG. 5) and remains therein during the rest of the lifting operation. Since the lower flange 40 of the locking ring is never expanded totally out of its groove 44 in the permanent guide base element 22, the retrieval tool 46 is always connected to the guide base 20 throughout its rise to the surface rig.

As the retrieval tool 46 is lifted to the surface a plurality of circumferential vent ports 92 in the upper end area of the housing 50 allow the seawater used in the running string 48 to exert hydraulic pressure on the piston, to drain from the string and the tool, thereby reducing the total weight to be lifted by the rig equipment and avoiding the need to drain the string and tool at the surface.

Figure 7:
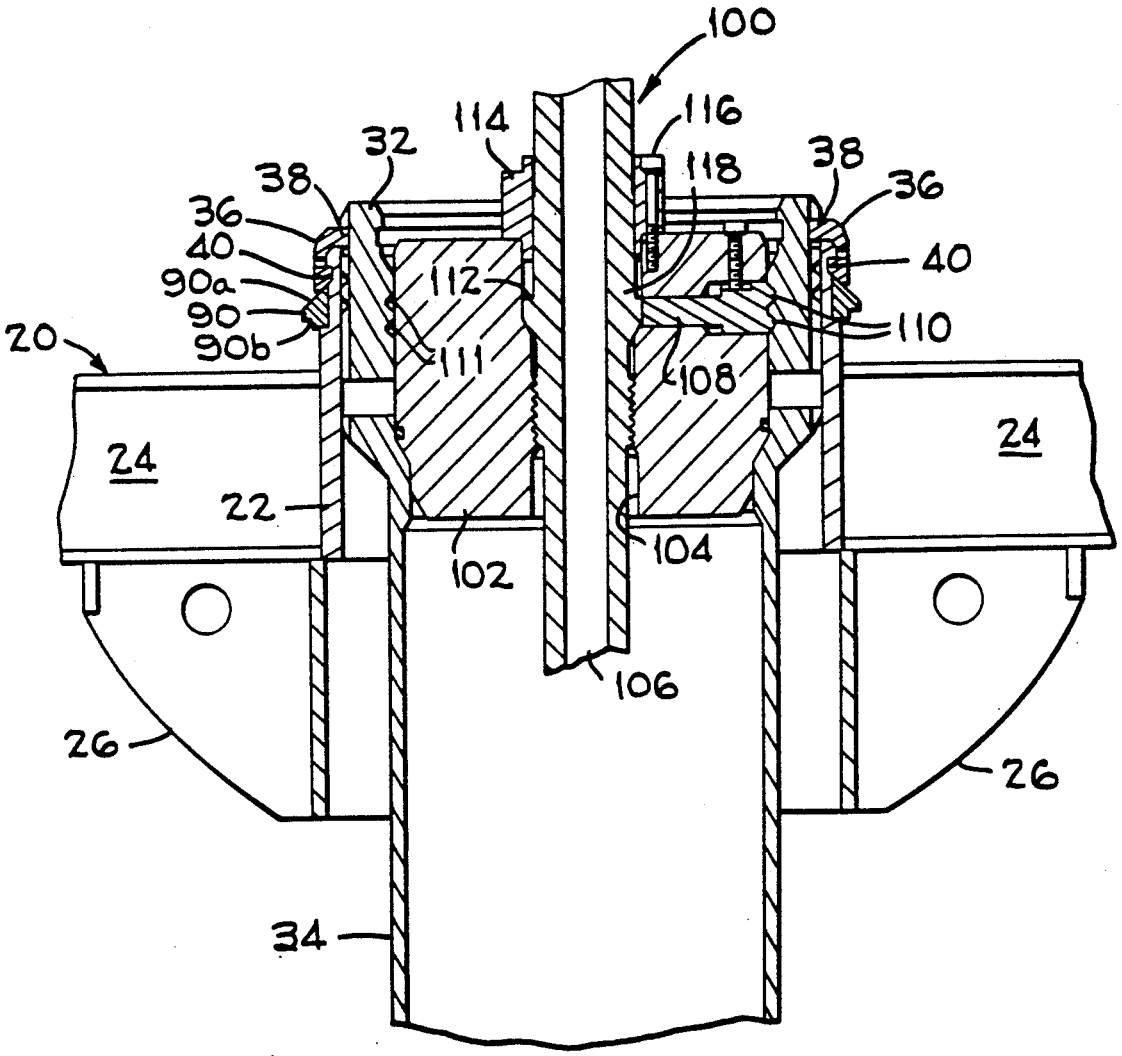
FIG. 7 is a fragmentary central sectional view of the permanent guide base, a conductor or other wellhead housing, and a wellhead running tool, with these components connected in preparation for running into a subsea well.

The permanent guide base 20 and the conductor head or housing 32, along with its attached conductor pipe string 34, can be run as a unit and installed in a subsea well by means of a wellhead running tool such as that illustrated in FIG. 7. The running tool 100 of FIG. 7 comprises a tool body 102 having a central bore 104 through which extends a pipe section 106 attached at its upper end to a pipe running string (not shown), and a radially oriented latch element 108 with external annular ribs 110 that reside in internal annular grooves 111 in the bore of the conductor housing 32 when the tool 100 is connected to the housing as seen in FIG. 7. After landing the guide base 20 on the temporary guide base (not shown) at the well site and jetting in or otherwise installing the conductor pipe and cementing it in the well, the pipe element 106 is rotated with respect to the tool body 102 to unthread it upwardly until an annular shoulder 112 on the pipe element 106 contacts an annular stop element 114 surrounding the pipe element and secured to the upper end of the tool body, such as by cap screws 116 (only one shown). As an annular enlargement 118 of the pipe element 106 moves upward and out of position behind the latch element 108, that element is freed for axial inward movement out of the grooves 111, whereby lifting of the tool body 102 causes the latch element 108 to be cammed inwardly and release the tool for retrieval.

Figure 8:
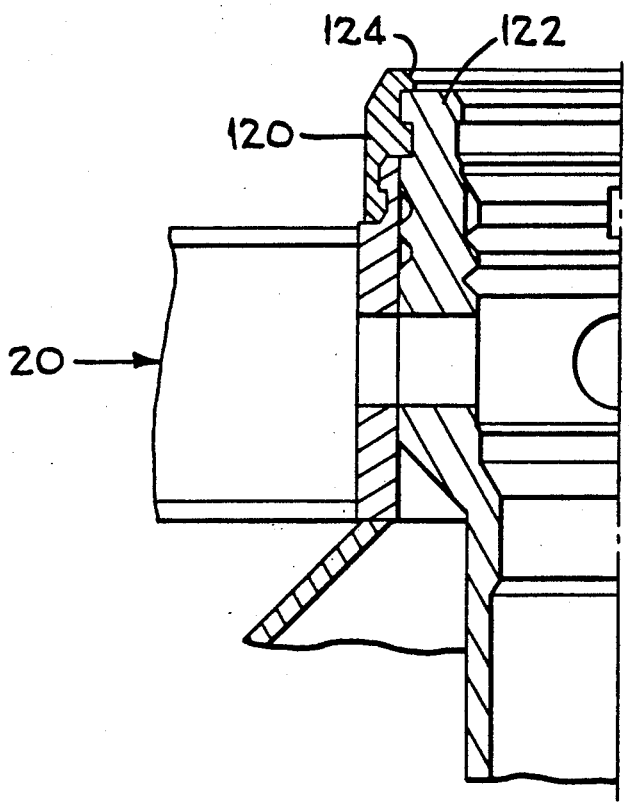
FIGS. 8 and 9 are fragmentary central sectional views of other locking ring embodiments interconnecting a releasable permanent guide base to a wellhead housing.

FIG. 8 illustrates a different configuration of locking ring 120 that can be used to releasably connect the permanent guide base 20 to a conductor pipe housing 122. The ring 120 resembles its counterpart 36 in the preferred embodiment described above, but also includes a third inward oriented annular flange 124 at its upper end that resides on top of the conductor housing 122.

Figure 9:
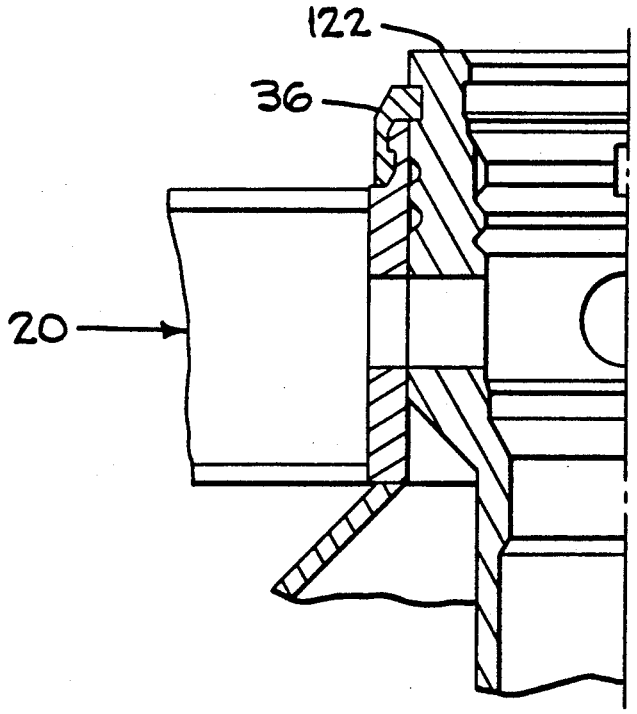
Figure 10:
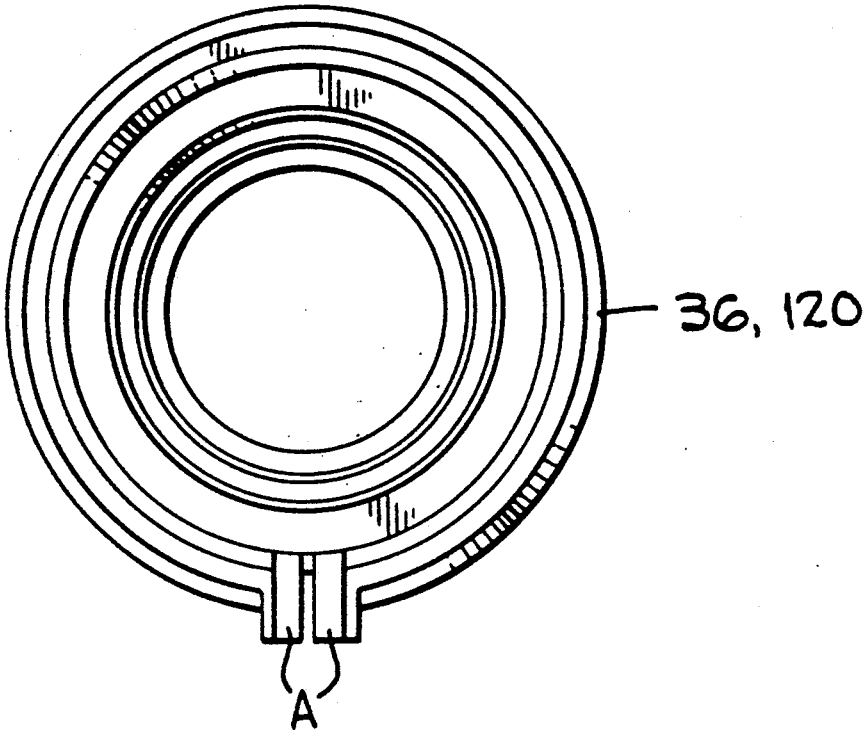
FIG. 10 is a plan view of the wellhead housing and the locking ring of FIG. 8.

FIGS. 9 and 10 illustrate the locking ring 36 connecting the permanent guide base 20 to conductor housing 122 of FIG. 8.

Figure 11:
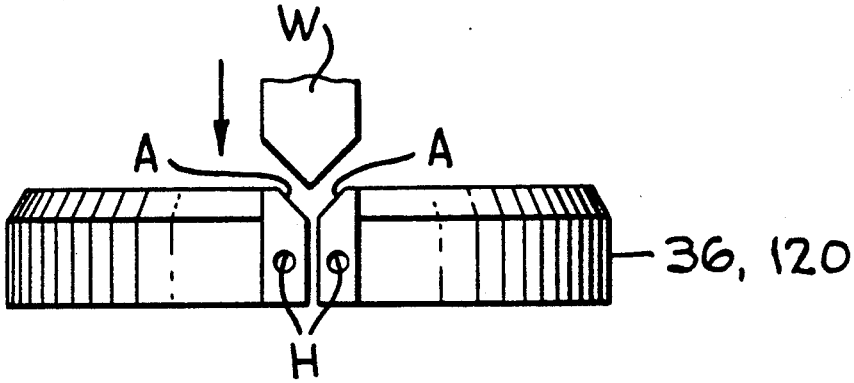
FIG. 11 is a side elevation of the locking ring of FIG. 10, and a portion of a wedge-type ring expanding tool.

The locking rings 120, 36 of FIGS. 8 and 9 can be released by a wedge W (FIG. 11) from above in a downward motion or from the side in a radial inward motion. These release operation can be accomplished with a tool lowered from the drilling rig, or by a remotely operated vehicle (ROV) at the permanent guide base. Downward movement of the wedge W between the inclined surfaces A, A of the locking rings at their splits will spread the splits and disengage the rings from their conductor housings. Similarly, radial inward movement of a wedge into the splits will spread the ring. The rings can include radial holes H (FIG. 11) to accept two tapered prongs of an ROV (not shown) which, when spread apart, release the rings from the conductor housing grooves.

Figure 12:
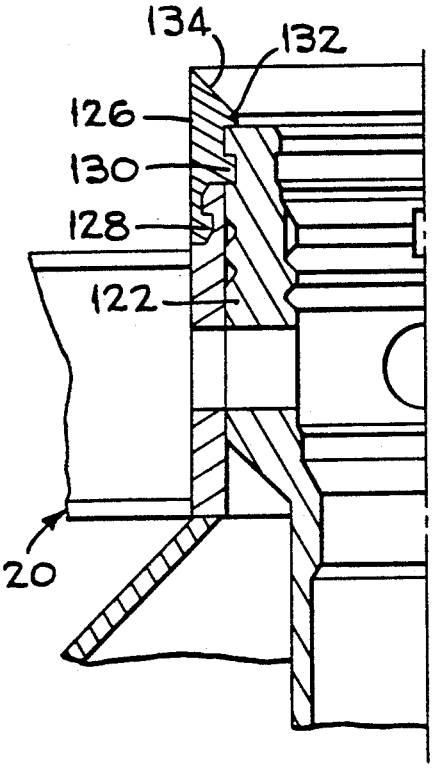
FIGS. 12 and 13 are views like FIGS. 8 and 9, showing additional embodiments of the locking ring.

FIG. 12 shows yet another embodiment of locking ring, herein 126, that resembles the ring 120 of FIG. 8 with respect to having three inward oriented annular flanges 128, 130, 132, but which also has a frusto-conical upper end surface 134.

Figure 13:
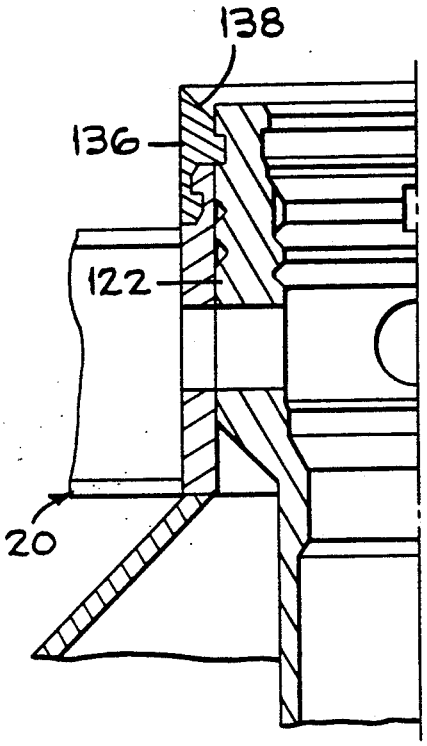

FIG. 13 illustrates another locking ring 136 resembling the locking ring 36 of FIGS. 1–8, but also having an upper end surface 138 of frusto-conical configuration.

Figure 14:
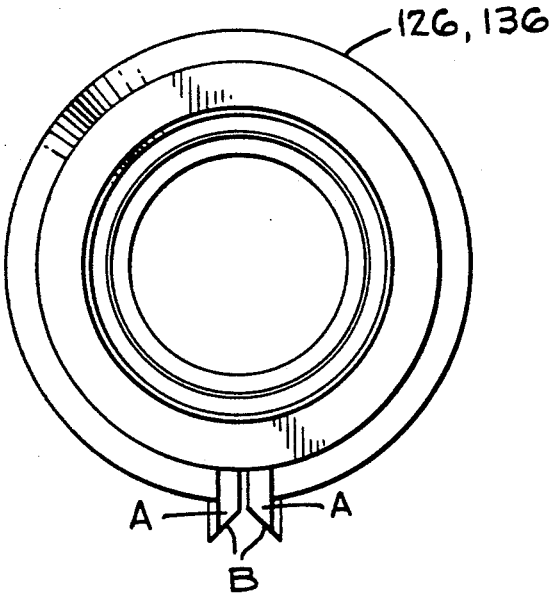
FIG. 14 is a plan view of the wellhead housing and the locking ring of FIG. 12.
Figure 15:
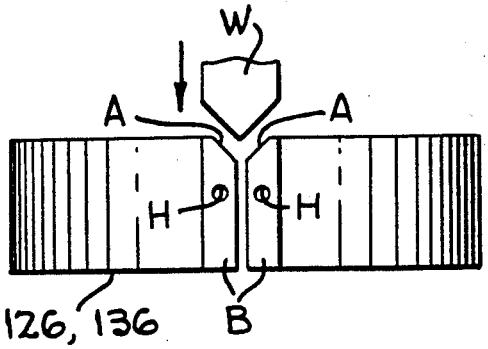
FIG. 15 is a side elevation of the locking ring of FIG. 24, together with a portion of a wedge-type ring expanding tool.

FIG. 14 and 15 illustrate the inclined surfaces A, A and tapered surfaces B, B, and the holes H, H, of the locking rings 126, 136 for cooperation with a downward or radially inward moving wedge W, or an ROV tool, to spread and disengage the rings from their conductor housing grooves, in the same manner as described above in reference to FIG. 11.

Figure 17:
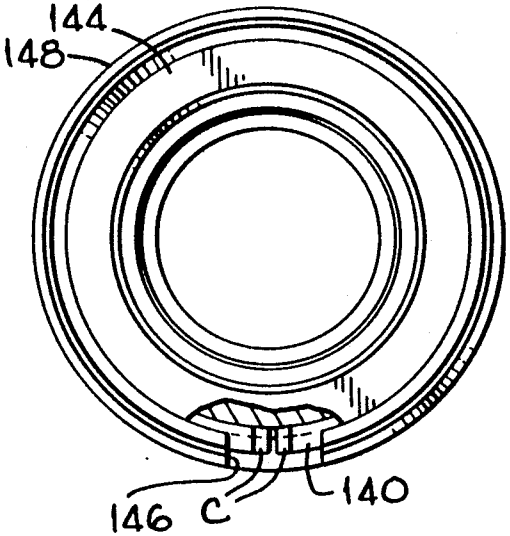
FIG. 17 is a plan view, with a portion broken away, of the wellhead housing, locking ring and surrounding central annular element of the retrievable guide base of FIG. 16.
Figure 18:
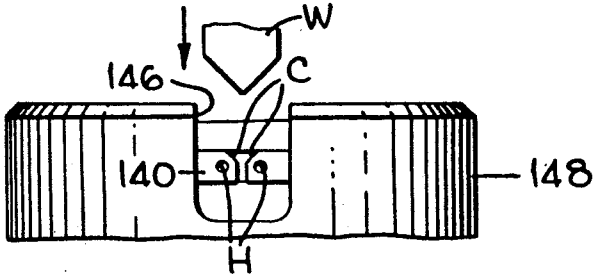
FIG. 18 is a fragmentary side elevation of the components shown in FIG. 17.
Figure 16:
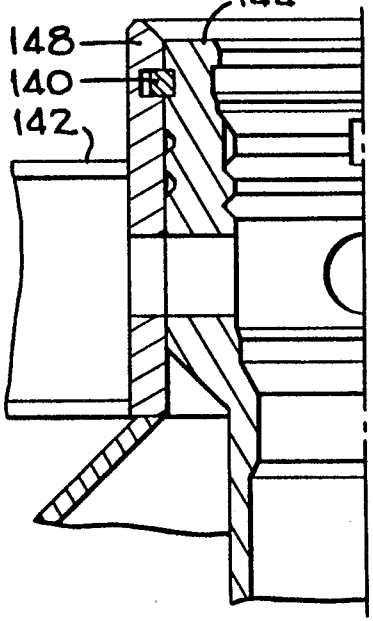
FIG. 16 is a view like FIGS. 8, 9, 12 and 13, showing another embodiment of locking ring.

FIGS. 16-18 illustrate still another embodiment of locking ring, herein 140, employed to lock a permanent guide base 142 to a conductor pipe housing 144 that it surrounds. The lock ring 140 is square in cross-section and has inclined surfaces C, C (FIGS. 17 and 18) at its split to accept a downward moving wedge W for spreading and disengaging the ring from the housing 144. The ring 140 also has radial holes H, H (FIG. 18) to accept an ROV tool that accesses the ring through a window 146 in the upper portion of the central tubular element 148 of the guide base 142.

Figure 19:
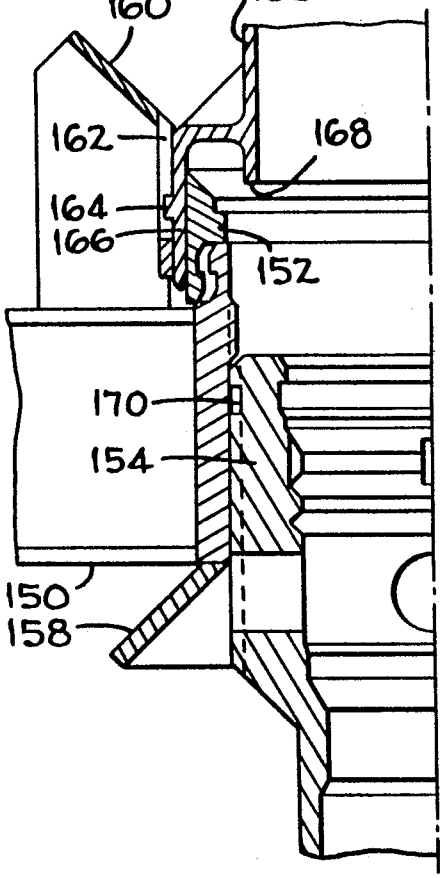
FIG. 19 is a view like FIG. 13, but showing the guide base and lock ring connected to a running tool and partially lowered onto the wellhead housing.

As represented in FIG. 19, a replacement permanent guide base 150 and a split locking ring 152 can be run and connected to a previously installed conductor housing 154 by a running recovery tool 156 attached to a running string (not shown). A lower stab funnel 158 is attached to the bottom of the replacement guide base 150 to help in stabbing the base onto the housing 154, and an upper funnel 160 on top of the guide base 150 with conventional J-slots 162 (only one shown) spaced around its interior provide a means to guide the tool 156 into position for the tool lugs 164 (only one shown) to engage the slots and releasably connect the tool to the base. Otherwise the guide base 150 can be of the same design as those referenced above.

The tool 156 has a centralizing sleeve 166 to center the locking ring 152 when a wedge (not shown) has been vertically installed between the ends (not shown) of the ring. The guide base 150 is oriented with the conductor housing 154 by conventional means, and then lowered until an annular stop shoulder 168 lands on the top of the housing. This properly locates the locking ring 152 so that the wedge can be removed to permit the ring to contract into the mating annular groove 170 in the outside of the housing 154, thereby releasably connecting the guide base 150 to the housing. The running tool 156 can then be "unjayed" from the guide base 150 in the usual manner, and retrieved to the surface for further use.

Although the best mode contemplated for carrying out the present invention has been herein shown and described, it will be apparent that modification and variation may be made without departing from what is regarded to be the subject matter of the invention.

What is claimed is:

1. A retrievable guide base for use on a subsea wellhead, said base comprising:

a) a central annular structural member for positioning around a well pipe housing, said housing having an external annular groove;

b) an annular groove in a surface of the structural member for receiving a split locking ring; and c) an axially, bi-directional locking ring carried in the annular groove of the base structural member, said ring being inherently biased into a contracted position wherein it resides in both the base structural member groove and the housing groove when said structural member and housing are in a predetermined functional relative position, thereby bi-directionally locking said base to said housing and preventing relative axial movement in either direction therebetween.

2. A retrievable guide base according to claim 1 wherein the bi-directional locking ring includes at least two radially inward extending annular flanges, one flange for engaging the housing groove and the other flange for engaging the guide base groove.

3. A retrievable guide base according to claim 2 wherein the bi-directional locking ring has a third radially inward extending annular flange that resides against the top of the housing when the ring is in its contracted position.

4. A retrievable guide base according to claim 1 wherein the bi-directional locking ring has a generally C-shaped cross-sectional configuration.

5. A retrievable guide base according to claim 1 wherein the bi-directional locking ring has a generally square cross-sectional configuration.

6. A retrievable guide base according to claim 1 including means to expand the bi-directional locking ring sufficiently to disengage the ring from the housing to release the guide base for retrieval.

7. A retrievable guide base according to claim 6 wherein the ring expanding means comprises an annular release element axially-slidably surrounding the base structural member beneath the bi-directional locking ring, whereby upward movement of the annular release element causes the bi-directional locking ring to expand from engagement with the housing.

8. A retrievable guide base according to claim 7 wherein the annular release element is a ring with a frusto-conical upper surface that cams the locking ring towards its expanded condition.

9. A retrieving tool for use with a pipe running string to retrieve a subsea well component from a remote location, said tool comprising a) a hollow housing with means for attachment to a pipe running string;

b) at least one retrieval pin assembly secured to the housing and functionable to engage a release element on a subsea well component and cause said release element to effect disengagement of the subsea well component from another subsea well structure; and c) means to lift the housing with respect to the subsea well structure to disengage the subsea well component therefrom.

10. A retrieving tool according to claim 9 wherein the means to lift the housing comprises a hydraulic piston for exerting a force between the housing and the subsea well component tending to axially move said housing from said component.

11. A retrieval pin assembly for a subsea well apparatus, said pin assembly comprising:

a) an outer sleeve element with a bore and means for attachment to a subsea well tool;

b) latch means axially slidably positioned within the sleeve element bore;

c) spring means to axially bias the latch means towards its functional position; and d) means for supporting said spring means in said sleeve element.

* * * * *